US007104621B2

(12) United States Patent
Choi

(10) Patent No.: US 7,104,621 B2
(45) Date of Patent: Sep. 12, 2006

(54) APPARATUS FOR PROTECTING DOOR GASKET OF REFRIGERATOR

(75) Inventor: Chang-bong Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 168 days.

(21) Appl. No.: 10/698,382

(22) Filed: Nov. 3, 2003

(65) Prior Publication Data

US 2004/0100168 A1 May 27, 2004

(30) Foreign Application Priority Data

Nov. 4, 2002 (KR) ..... 10-2002-0067916

(51) Int. Cl.
*A47B 95/00* (2006.01)
*A47B 96/04* (2006.01)

(52) U.S. Cl. ..... 312/296; 312/402; 312/405

(58) Field of Classification Search ..... 312/296, 312/330.1, 348.4, 327, 328, 298, 404, 402, 312/236, 116, 401, 311, 323, 405; 62/382; 296/146.11; 49/484.1, 152, 475.1, 153, 155, 49/156

See application file for complete search history.

(56) References Cited

U.S. PATENT DOCUMENTS 2,591,003 A * 4/1952 Philipp ..... 312/405
3,009,725 A * 11/1961 Koch ..... 292/251.5
5,702,168 A * 12/1997 Shin ..... 312/405
5,860,717 A * 1/1999 Mizrahi ..... 312/322
5,915,805 A * 6/1999 Lee ..... 312/405
5,975,663 A * 11/1999 Becker ..... 312/405
2003/0071549 A1* 4/2003 Tarantik ..... 312/405
2003/0132690 A1* 7/2003 Shin et al. ..... 312/405

* cited by examiner

*Primary Examiner*—Janet M. Wilkens
*Assistant Examiner*—Tim Ayres
(74) *Attorney, Agent, or Firm*—Fleshner & Kim, LLP

(57) ABSTRACT

An apparatus for protecting a door gasket of a refrigerator is provided. The apparatus includes a cushioning member positioned either on a door or on a main body of the refrigerator to prevent any contact between the gasket and the main body of the refrigerator as the door tilts open to provide access to the storage space in the refrigerator. The cushioning member may include a roller, or a plurality or rollers, which form an interface between the door and the main body as the door is tilted relative to the main body, and which allow the outer periphery of the door to maintain sliding contact with the main body as the door continues to tilt. The sliding interface provided by the cushioning member precludes damage to the gasket, which would otherwise be compressed between the door and the main body as the door tilts relative to the main body, thus maintaining the integrity of the seal provided by the gasket.

18 Claims, 6 Drawing Sheets

APPARATUS FOR PROTECTING DOOR GASKET OF REFRIGERATOR

BACKGROUND OF THE INVENTION

1. Field of the Invention

The present invention relates to a door of a drawer type refrigerator, and more particularly, to a door for a drawer of a drawer type refrigerator, which is provided with cushioning members for preventing a door gasket from being pressed against a main body of the refrigerator and subsequently deformed when the tiltable door of the refrigerator is tilted.

2. Description of the Prior Art

FIG. 1 is a perspective view of a general drawer type refrigerator with a tiltable door for a drawer of the refrigerator. As shown in the figure, a storage space is provided within a main body 1 of the refrigerator and is caused to be open or close by the door 2 disposed in front of the storage space. A lower end of the door 2 is provided with a hingedly connectable structure so that the door 2 can be pivoted thereon when it is pulled forward. The door 2 is also provided with a link 4 for limiting tilting thereof to a predetermined tilting range. Further, a rubber gasket (not shown) is installed along the periphery of an inner surface of the door 2. The gasket prevents cold air within the storage space from leaking out in a state where the door 2 is closed.

Movable rails 9 are installed on both side surfaces of a drawer body 3 on the inner side of the door 2. The movable rails 9 are supported by fixed rails (not shown) installed on both inner side surfaces of the main body 1 of the refrigerator so as to be moved together with the door 2 when the door 2 is pushed or pulled, thereby enabling the drawer body to slide in and out in a drawer fashion.

The door 2 is connected to a lower end of the drawer body 3 through a hinge pin 7 to pivot thereon. The link 4 for limiting the tilting of the door 2 is connected to an upper end of the drawer body 3.

With such a constitution, the door 2 is slid out in a drawer fashion and also opened while pivoting on the hinge pin 7 when the door 2 is pulled forward.

However, when the door 2 is tilted, it is repeatedly pressed against the main body 1 of the refrigerator. If such tilting is consecutively repeated for a long time, a problem occurs in that a portion of the gasket disposed at the lower end of the door 2 may be deformed. This will be described in detail with reference to FIGS. 2*a* to 2*c* that show operational states of the door.

FIG. 2*a* shows a state where the door 2 is not tilted. In such a state, the gasket 8 is in close contact with the main body 1 of the refrigerator to prevent cold air from leaking out.

FIG. 2*b* shows a state where the door 2 is slightly tilted. As the door 2 is progressively tilted, a portion of the gasket 8 is pressed against the main body 1 of the refrigerator.

FIG. 2*c* shows a state where the door 2 is fully tilted, wherein the portion of the gasket 8 is more strongly pressed against the main body 1 of the refrigerator. When such a state is repeated consecutively, the gasket 8 of the door would be deformed.

Accordingly, the prior art has a problem in that the repeated tilting of the door 2 causes the deformation of the gasket 8, thereby generating energy loss and noise and deteriorating an external appearance of the refrigerator.

SUMMARY OF THE INVENTION

The present invention is conceived to solve the aforementioned problems. An object of the present invention is to prevent a portion of a door gasket disposed at a lower end of a tiltable door of a refrigerator from being pressed against a main body of the refrigerator and deformed, thereby keeping cold air from leaking out through a space between the door and the main body of the refrigerator.

In order to achieve the object, an apparatus for protecting a door gasket of a refrigerator according to the present invention comprises a drawer body with a storage space capable of being put in and taken out from a main body of the refrigerator; a door which is connected to one side of the drawer body to be pivotable on an axis of rotation and of which a back surface comes into close contact with a front face of the main body of the refrigerator in a state where the drawer body is put in the main body of the refrigerator; a gasket provided between the periphery of the back surface of the door and the front face of the main body of the refrigerator; and a cushioning member disposed below the gasket to prevent contact of the gasket with the main body of the refrigerator when the door pivots on the axis of rotation.

The cushioning member is installed on the door or the main body of the refrigerator and adapted to prevent deformation of the gasket.

Preferably, the cushioning member comprises a roller, and a plurality of cushioning members are installed below the gasket.

BRIEF DESCRIPTION OF THE DRAWINGS

The above and other objects, features and advantages of the invention will become more apparent from reading the following description of a preferred embodiment taken in connection with the accompanying drawings in which.

DETAILED DESCRIPTION OF THE INVENTION

Hereinafter, the present invention will be described in detail in connection with an embodiment of the present invention illustrated in the accompanying drawings.

Figure 1:
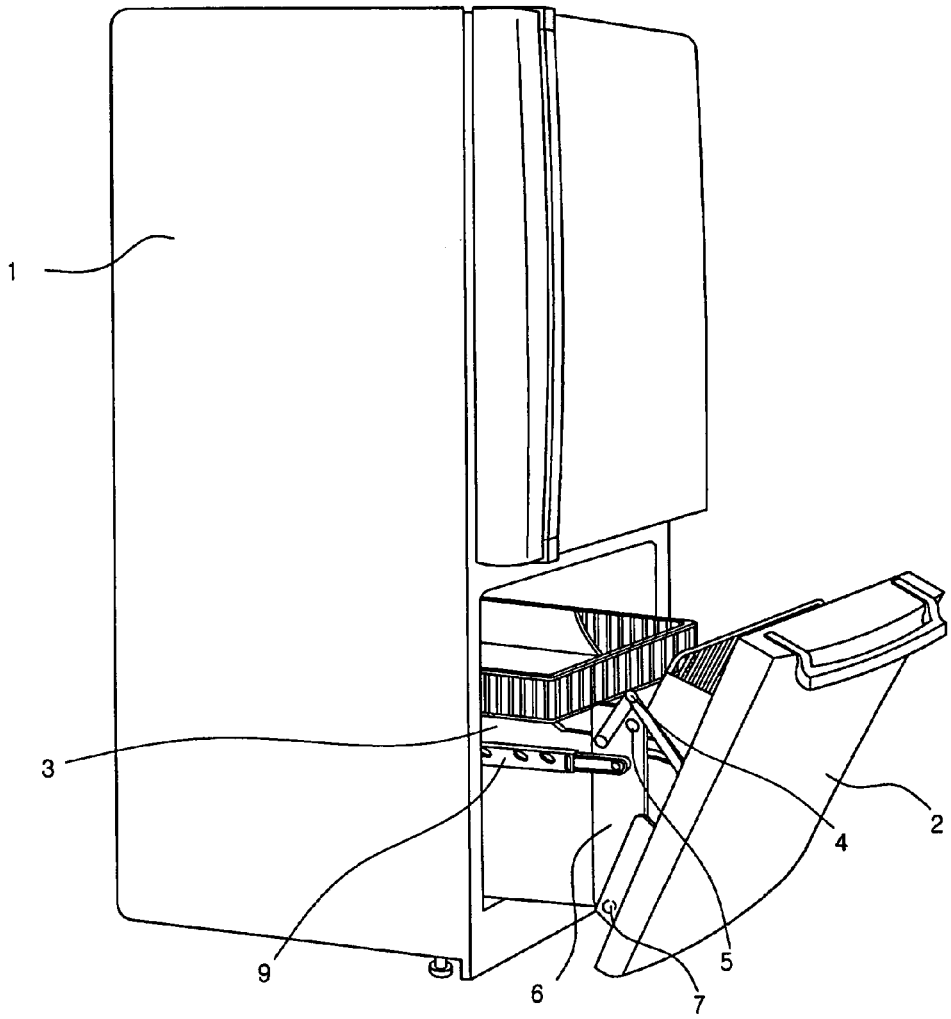
FIG. 1 PRIOR ART
FIG. 1 is a perspective view of a conventional drawer type refrigerator.
Figure 2A:
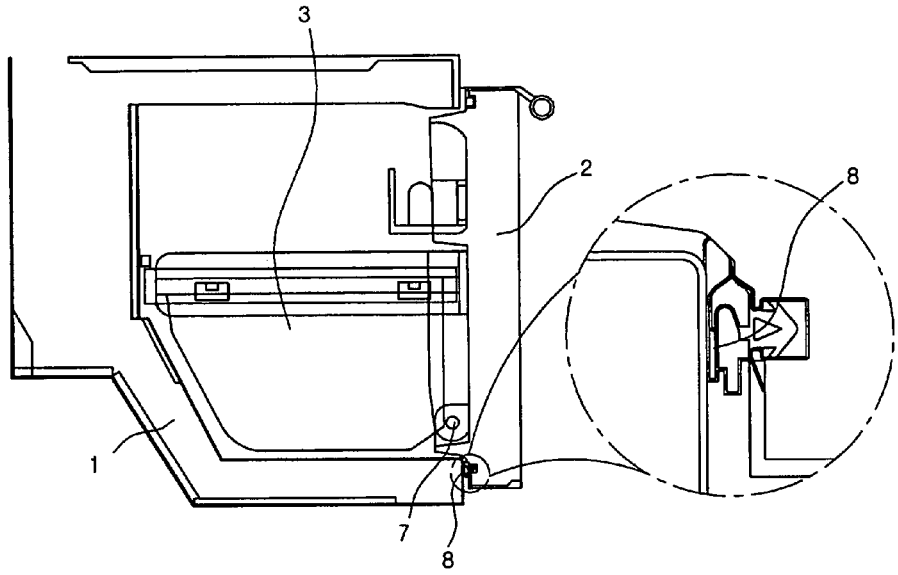
FIG. 2A PRIOR ART
FIGS. 2*a* to 2*c* show sequential operational states of tilting of a conventional door of the drawer type refrigerator.
Figure 2B:
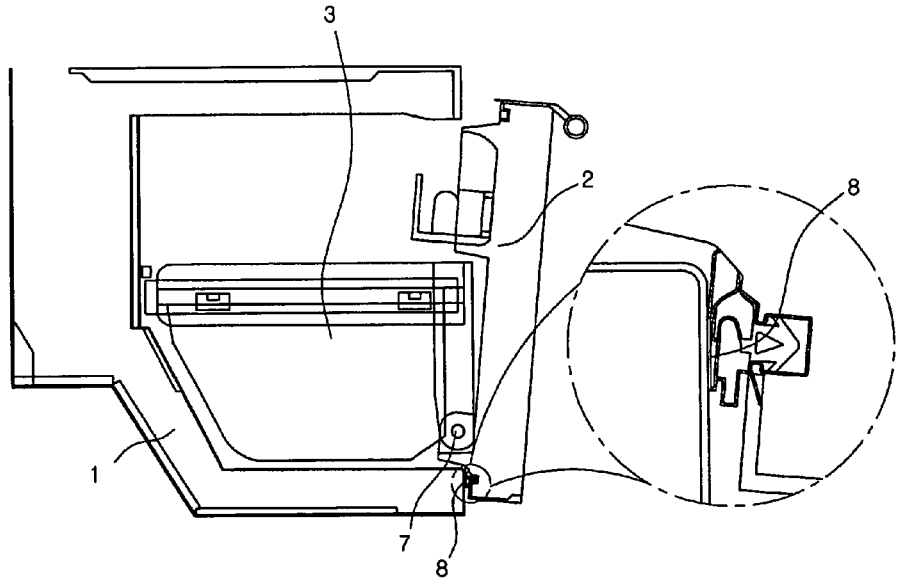
FIG. 2B PRIOR ART
Figure 2C:
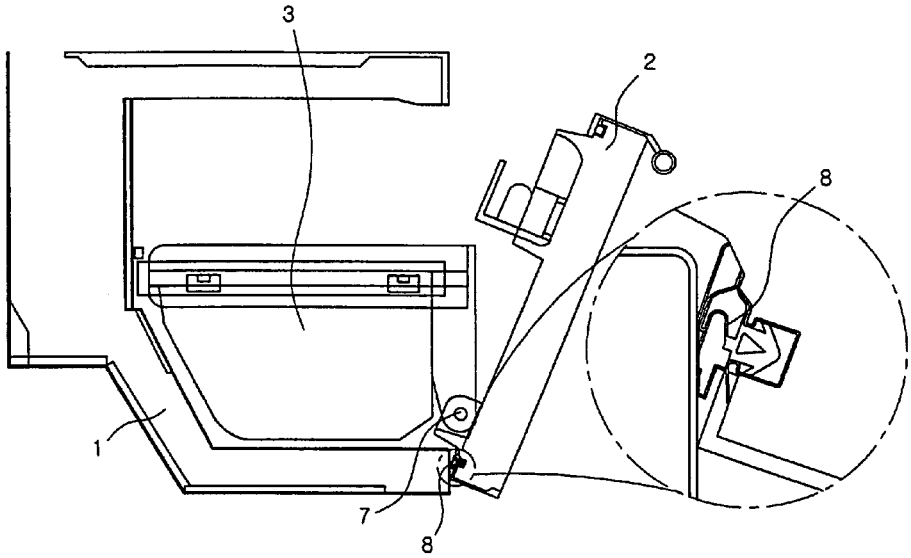
FIG. 2C PRIOR ART
Figure 3A:
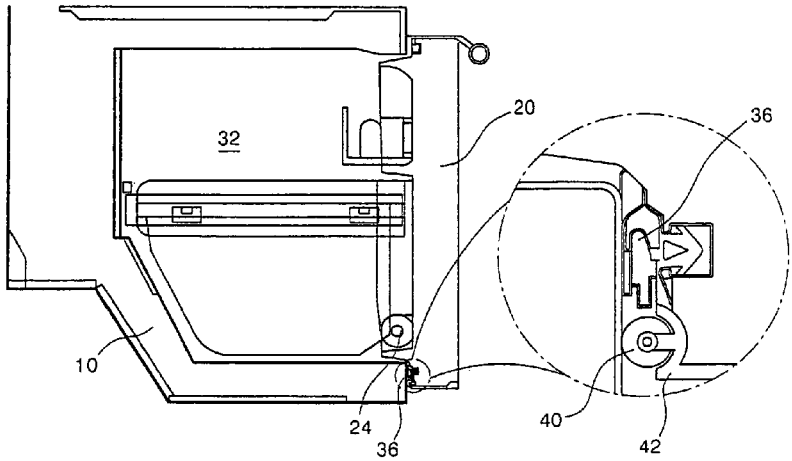
FIGS. 3*a* to 3*c* show sequential operational states of tilting of a door of a drawer type refrigerator according to an embodiment of the present invention.
Figure 3B:
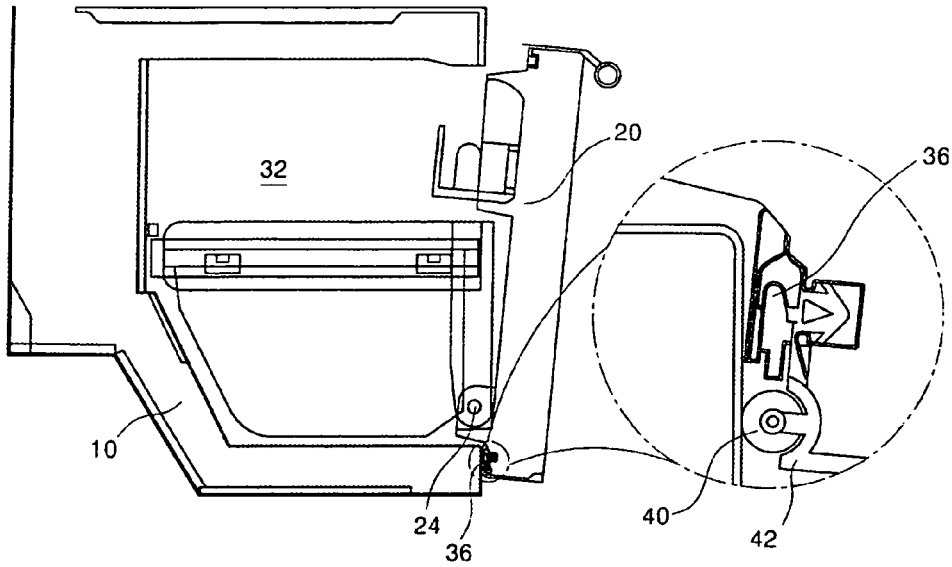
Figure 3C:
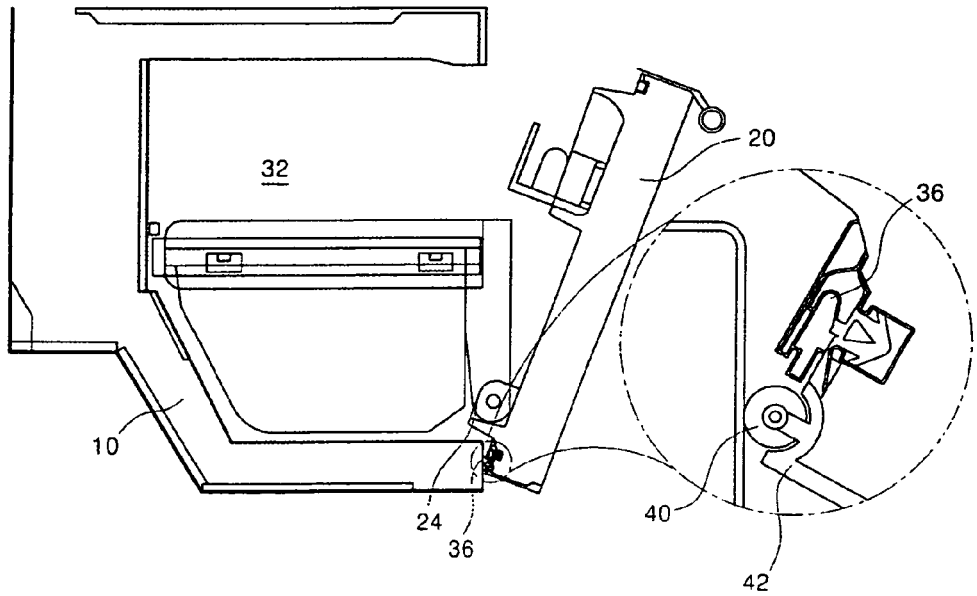

FIGS. 3*a* to 3*c* show sequential operational states of tilting of a door of a drawer type refrigerator according to an embodiment of the present invention. As shown in the figures, a drawer body 32 that defines a storage space and can be slid in and out in a drawer fashion is placed in the main body 10 of the refrigerator.

A lower end of the drawer body 32 is provided with a hinge bore with which a hinge pin 24 provided at a lower end of a door 20 is hingedly coupled. Further, the drawer body 32 is connected to the door 20 through a link (not shown) to limit tilting of the door 20 to a predetermined range.

The door 20 is positioned in front of the drawer body 32. A gasket 36 is installed along a lower end portion of the periphery of the door 20 below a position where the hinge pin 24 is provided, and a roller 40 is installed in a cap deco portion 42 provided below a position where the gasket 36 is installed.

When the door 20 of the present invention is pivoted and opened, the roller 40 and the gasket 36 are placed below the hinge pin 24 serving as an axis of rotation and the roller 40 is placed below the gasket 36, so that the roller 40 can first come earlier than the gasket 36 into contact with the main body 10 of the refrigerator. Therefore, the gasket 36 is prevented from being pressed against the main body 10 of the refrigerator.

Figure 4:
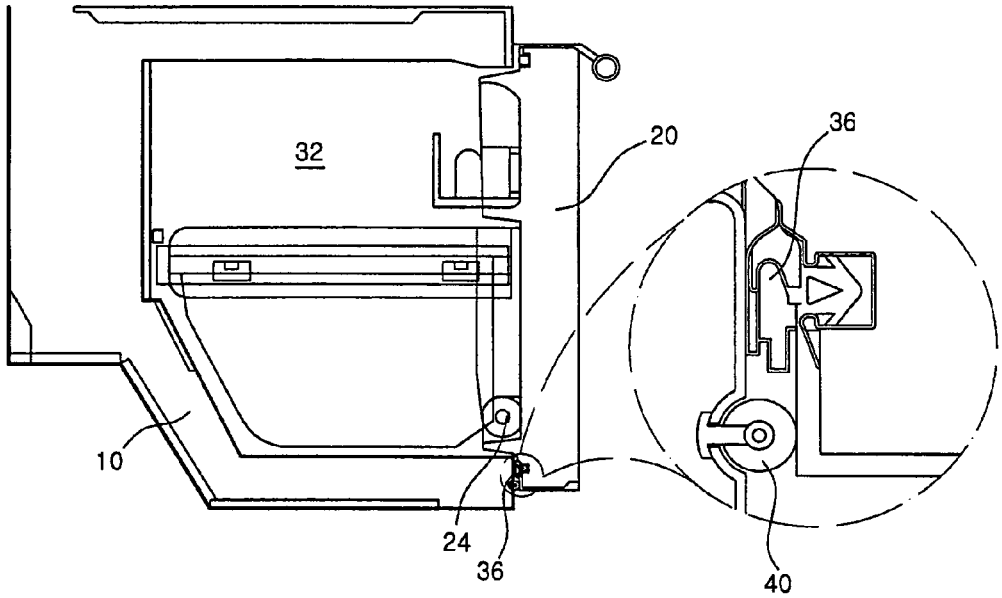
FIG. 4 is a side view of a tilting door of a drawer type refrigerator, in accordance with an embodiment of the invention.
Figure 5A:
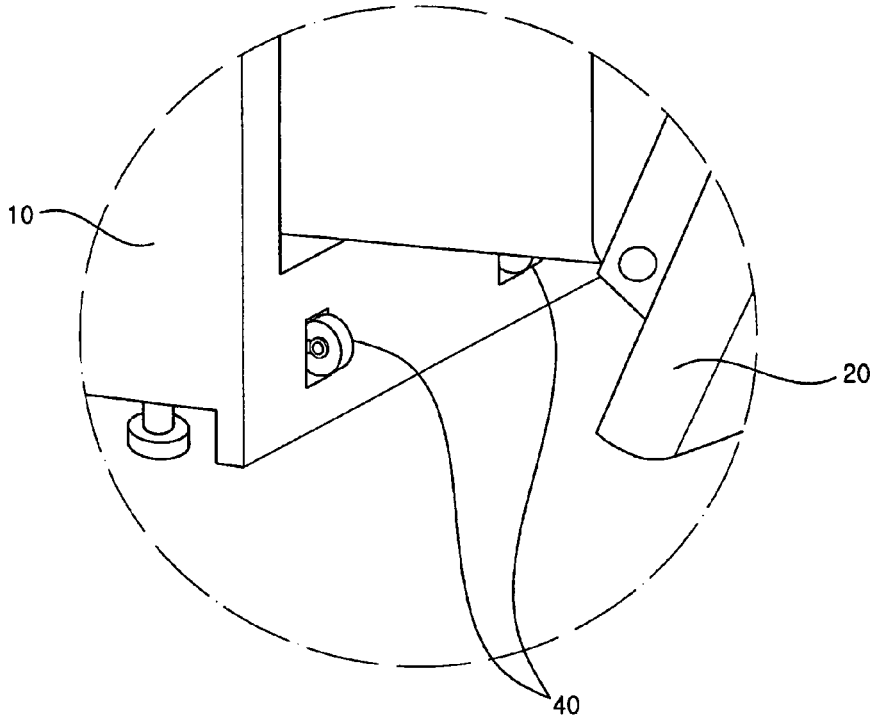
FIGS. 5*a* to 5*b* are perspective views of a tilting drawer of a drawer type refrigerator, in accordance with embodiments of the invention.
Figure 5B:
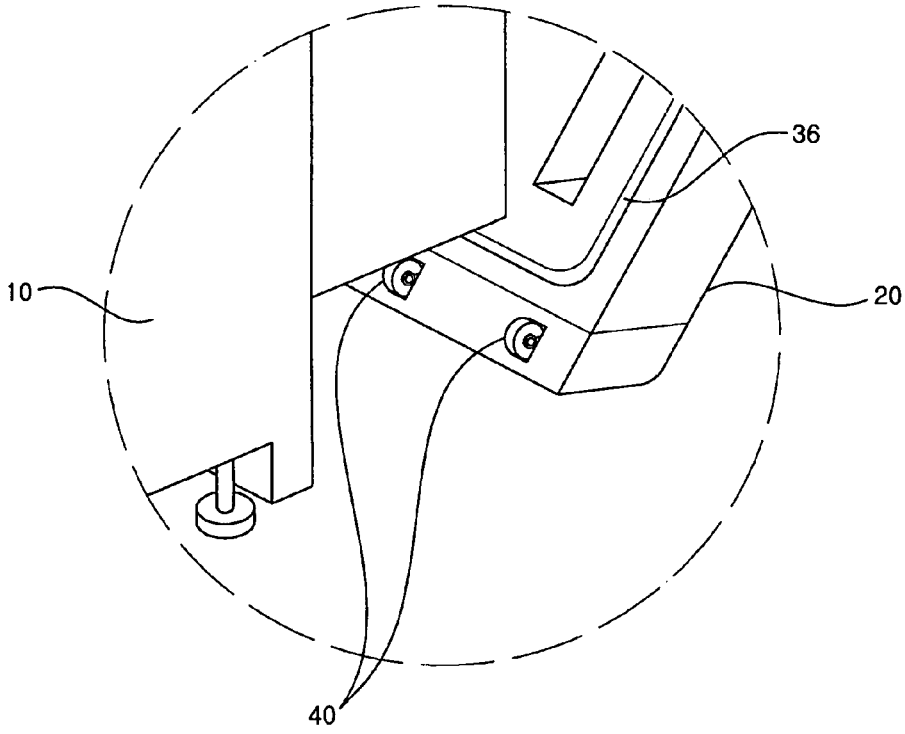

A cushioning member such as the roller 40 may be installed at a lower end portion of the main body 10 of the refrigerator, as shown, for example, in FIG. 4. It will be apparent that even though the cushioning member is installed at the lower end portion of the main body 10 of the refrigerator rather than the door, the cushioning member can perform the same function. Further, a plurality of rollers 40 may be installed at a predetermined interval below the gasket 36, on either the door or the main body, as shown, for example, in FIGS. 5*a* and 5*b* to distribute the pressing force exerted on the main body of the refrigerator.

FIG. 3*a* shows a state where the door 20 of the refrigerator is not tilted. In such a state, the door 20 is in a closed state, and thus, the gasket 36 is in close contact with the main body 10 of the refrigerator to prevent cold air in the refrigerator from leaking out and the roller 40 is not in contact with the main body 10 of the refrigerator.

FIG. 3*b* shows a state where the door 20 is slightly-tilted. This state corresponds to a state where a lower portion of the gasket 36 would begin to be pressed against the main body 10 of the refrigerator in the prior art. However, according to the present invention, the roller 40 first comes into contact with and is pressed against the main body 10 of the refrigerator. Thus, the gasket 36 is prevented from being directly pressed against the main body 10 of the refrigerator. At this time, since the roller 40 comes into rolling contact with the main body 10 of the refrigerator, the main body 10 is not deformed by the roller.

FIG. 3*c* shows a state where the door 20 is fully tilted. This state corresponds to a state where a portion of the gasket 36 would be more strongly pressed against the main body 10 of the refrigerator in the prior art. However, according to the present invention, the roller 40 first comes earlier than the gasket 36 into rolling contact with the main body 10 of the refrigerator. Thus, the gasket 36 is kept from coming into contact with the main body 10 of the refrigerator. Consequently, deformation of the gasket due to pressing thereof against the main body of the refrigerator does not occur in the gasket.

As described above, the technical spirit of the present invention is to install the cushioning member for preventing the deformation of the door gasket due to the pressing thereof against the main body of the refrigerator when the door of the refrigerator is pivoted and opened.

It will be apparent that those skilled in the art can make various modifications within the technical spirit and scope of the present invention. For example, various types of cushioning members other than the roller may be installed, and the position where the cushioning member is installed may also be variously modified.

According to the present invention, the door of the drawer type refrigerator is provided with the cushioning member, thereby preventing the door gasket from being pressed against the main body of the refrigerator and deformed. Loss in cold air due to deformation of the gasket never occurs, and a clean external appearance can be maintained. Further, it can be expected to obtain effects of reduction in noise upon opening and closing the door.

What is claimed is:

1. An apparatus for protecting a door gasket of a refrigerator, comprising:

a drawer body including a storage space configured to be put into and taken out of a main body of a refrigerator;

a door coupled to one side of the drawer body and configured to pivot about an axis of rotation which is positioned proximate one end portion of the door, wherein an inner peripheral surface of the door is configured to align with a front face of the main body of the refrigerator when the drawer body is positioned in the main body of the refrigerator;

a gasket disposed between the axis of rotation and an edge portion of the one end portion of the door, wherein the gasket is configured to be positioned between the inner peripheral surface of the door and the front face of the main body of the refrigerator when the drawer body is positioned in the main body of the refrigerator and the door is in a closed position; and a cushioning member positioned between the gasket and the edge portion of the one end portion of the door, wherein the cushioning member is configured to prevent over compression of the gasket when the door pivots about the axis of the rotation.

2. The apparatus as claimed in claim 1, wherein the cushioning member comprises at least one roller.

3. The apparatus of claim 2, wherein the at least one roller is configured to provide rolling contact between the door and the front face of the main body as the door pivots about the axis of rotation.

4. The apparatus of claim 3, wherein the rolling contact provided by the at least one roller prevents compression of the gasket between the door and the main body as the door pivots about the axis of rotation.

5. The apparatus as claimed in claim 1, wherein the cushioning member is configured to be installed on the door.

6. The apparatus as claimed in claim 1, wherein the cushioning member is configured to be installed on the main body of the refrigerator.

7. The apparatus as claimed in claim 1, wherein the gasket is installed on the door.

8. The apparatus as claimed in claim 1, wherein the cushioning member comprises a plurality of rollers.

9. The apparatus of claim 1, wherein the axis of rotation is substantially coincident with a position of a hinge pin which couples a lower end of the door to a lower portion of the drawer body.

10. The apparatus of claim 9, wherein an upper end of the door is configured to pivot about the hinge pin such that the upper end of the door tilts outward and downward as the door is opened.

11. A device configured to protect a door gasket, comprising:

a door coupled to an apparatus and configured to pivot about an axis of rotation;

a hinge pin that couples the door and the apparatus so that the door can pivot about an axis of rotation defined by the hinge pin;

a gasket provided between a surface portion of the door facing an interior of the apparatus, and between the hinge pin and an outer edge of the door; and a cushioning member comprising at least one roller positioned between the gasket and the outer edge of the door, wherein the at least one roller is configured provide rolling contact between the door and the front face portion of the apparatus as the door pivots about the hinge pin, and wherein the cushioning member is configured to preclude over compression of the gasket as the door pivots.

12. The device of claim 11, wherein the gasket is configured to form a seal between the surface portion of the door facing the interior portion of the apparatus and a front face of the apparatus when the door is in a closed position.

13. The device of claim 11, wherein the rolling contact provided by the at least one roller prevents compression of the gasket between the door and the apparatus as the door pivots about the hinge pin.

14. The device of claim 11, wherein the at least one roller comprises a plurality of rollers installed on the door.

15. The device of claim 11, wherein the apparatus comprises a refrigerator.

16. The device of claim 15, wherein the apparatus comprises a drawer type refrigerator, and wherein the door is coupled to a drawer body configured to slide into and out of a receiving space of the drawer type refrigerator.

17. The device of claim 16, wherein the door is configured to rotate about a lower end portion thereof such that an upper portion of the door pivots outward and downward as the door is opened.

18. A drawer type refrigerator comprising the device of claim 11.

* * * * *